US008305402B2

(12) United States Patent
Chung et al.

(10) Patent No.: US 8,305,402 B2
(45) Date of Patent: Nov. 6, 2012

(54) PLASMA DISPLAY DEVICE

(75) Inventors: Moon Shick Chung, Gumi-si (KR); Choon Sub Kim, Gumi-si (KR); Dong Hyuk Park, Gumi-si (KR)

(73) Assignee: LG Electronics Inc., Seoul (KR)

( * ) Notice: Subject to any disclaimer, the term of this patent is extended or adjusted under 35 U.S.C. 154(b) by 474 days.

(21) Appl. No.: 12/560,762

(22) Filed: Sep. 16, 2009

(65) Prior Publication Data

US 2010/0066768 A1 Mar. 18, 2010

(30) Foreign Application Priority Data

Sep. 17, 2008 (KR) ..... 10-2008-0091234

(51) Int. Cl.
*G09G 5/10* (2006.01)

(52) U.S. Cl. ..... 345/690; 345/60; 345/72

(58) Field of Classification Search ..... None
See application file for complete search history.

(56) References Cited

U.S. PATENT DOCUMENTS

| | | | | |
|---|---|---|---|---|
| 7,999,767 | B2 * | 8/2011 | Jung et al. | 345/68 |
| 2002/0130823 | A1 * | 9/2002 | Takayama | 345/60 |
| 2003/0058193 | A1 * | 3/2003 | Seo | 345/60 |
| 2009/0058766 | A1 * | 3/2009 | Choi | 345/60 |
| 2009/0135094 | A1 * | 5/2009 | Shibata et al. | 345/42 |
| 2009/0225007 | A1 * | 9/2009 | Kumagai et al. | 345/60 |

* cited by examiner

*Primary Examiner* — Jason Olson
(74) *Attorney, Agent, or Firm* — Ked & Associates LLP

(57) ABSTRACT

A plasma display device is provided. The plasma display device includes a plasma display panel (PDP) having an upper substrate, a lower substrate, a plurality of scan electrodes and a plurality of sustain electrodes formed on the upper substrate, and a plurality of address electrodes formed on the lower substrate; and a driver applying driving signals to the plurality of electrodes, wherein a reset discharge occurs in a part of discharge cells. The plasma display device can contribute to the reduction of dark-area luminance and the improvement of dark-room contrast ratio.

20 Claims, 18 Drawing Sheets

PLASMA DISPLAY DEVICE

This application claims priority from Korean Patent Application No. 10-2008-0091234 filed on Sep. 17, 2008 in the Korean Intellectual Property Office, the disclosure of which is incorporated herein by reference in its entirety.

BACKGROUND OF THE INVENTION

1. Field of the Invention

The present invention relates to a plasma display device, and more particularly, to a plasma display device in which a reset discharge operation is performed alternately in a plurality of sub-discharge cells of each discharge cell.

2. Description of the Related Art

Plasma display panels (PDPs) display images by exciting phosphors with the use of vacuum ultraviolet (VUV) rays obtained by a discharge of the mixture of inert gases.

PDPs are generally easy to be implemented as thin large-scale display devices. In addition, since PDPs have a simple structure, it is generally easy to fabricate PDPs. Moreover, PDPs generally have a higher luminance and higher light-emission efficiency than other flat-panel display devices. Alternating-current (AC) surface-discharge tri-electrode PDPs, in particular, can accumulate wall charges thereon during a discharge operation and can thus protect electrodes against sputtering resulting from the discharge operation. Therefore, AC surface-discharge tri-electrode PDPs can be driven even in a low-voltage environment and have a relatively long lifetime.

In order to realize various grayscale levels for an image to be displayed, PDPs may be driven in a time-division manner in which each frame is divided into a reset period for initializing all cells, an address period for selecting a number of cells, and a sustain period for causing a display discharge operation in the selected cells. During the reset period, a reset discharge operation is performed in all cells. As a result, the dark area luminance of a PDP may be as high as about 0.3-0.5 cd/m$^2$. Thus, there is a clear limit in improving the dark room contrast ratio of a PDP due to such a high dark area luminance.

SUMMARY OF THE INVENTION

The present invention provides a plasma display device in which a reset discharge operation is performed alternately in a plurality of sub-discharge cells of each discharge cell.

According to an aspect of the present invention, there is provided a plasma display device including a plasma display panel (PDP) having an upper substrate, a lower substrate, a plurality of scan electrodes and a plurality of sustain electrodes formed on the upper substrate, and a plurality of address electrodes formed on the lower substrate; and a driver applying driving signals to the plurality of electrodes, wherein a reset discharge occurs in a part of discharge cells.

According to another aspect of the present invention, there is provided a plasma display device including a PDP having an upper substrate, a lower substrate, a plurality of scan electrodes and a plurality of sustain electrodes formed on the upper substrate, and a plurality of address electrodes formed on the lower substrate; and a driver applying driving signals to the plurality of electrodes, wherein at least one of a plurality of subfields of a frame includes a setup period for applying a first reset signal whose level gradually increases from a first voltage to a second voltage to the scan electrodes, and during the setup period, a third voltage is supplied to the address electrodes corresponding to a part of discharge cells, and a fourth voltage, which is a positive voltage higher than the third voltage is supplied to the other address electrodes.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

A flat panel display device according to the present invention will hereinafter be described in detail with reference to the accompanying drawings in which exemplary embodiments of the invention are shown. In the exemplary embodiments of the present invention, the flat panel display device is a plasma display device. However, the present invention is not restricted to a plasma display device. That is, the present invention can be applied to various flat panel display devices other than a plasma display device, for example, a liquid crystal display (LCD) device or an organic light-emitting diode (OLED) device.

Figure 1:
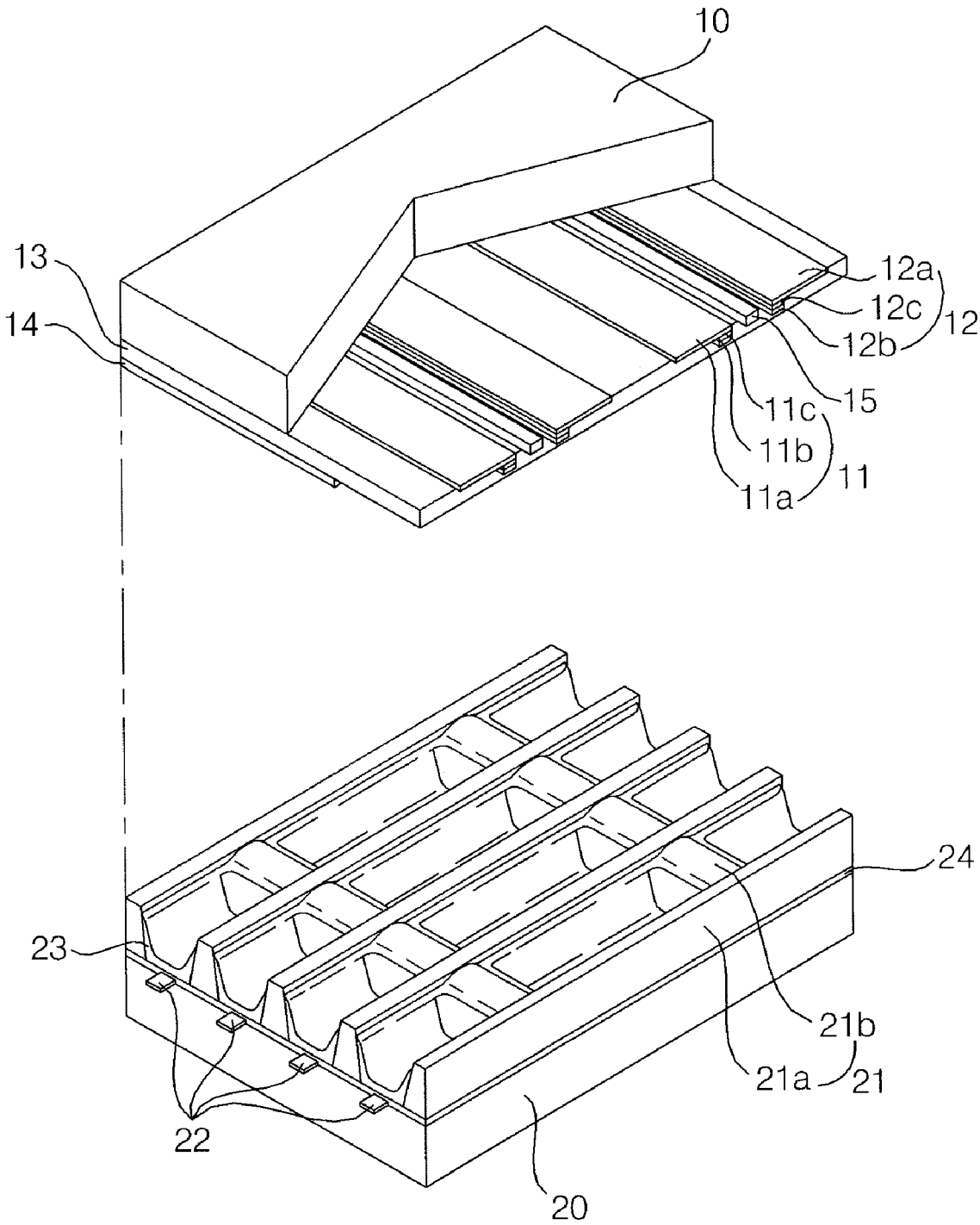
FIG. 1 illustrates a perspective view of a plasma display panel (PDP) according to an exemplary embodiment of the present invention.

FIG. 1 illustrates a perspective view of a plasma display panel (PDP) according to an exemplary embodiment of the present invention. Referring to FIG. 1, the PDP may include an upper substrate 10, a plurality of electrode pairs formed on the upper substrate 10, a lower substrate 20, and a plurality of address electrodes 22 formed on the lower substrate 20. Each of the plurality of electrode pairs may include a scan electrode 11 and a sustain electrode 12.

More specifically, each of the plurality of electrode pairs may include transparent electrodes 11*a* and 12*a* and bus electrodes 11*b* and 12*b*. The transparent electrodes 11*a* and 12*a* may be formed of indium-tin-oxide (ITO). The bus electrodes 11*b* and 12*b* may be formed of a metal such as silver (Ag) or chromium (Cr) or may include a stack of chromium/copper/chromium (Cr/Cu/Cr) or a stack of chromium/aluminium/chromium (Cr/Al/Cr). The bus electrodes 11*b* and 12*b* may be formed on the transparent electrodes 11*a* and 12*a*, respectively, and may reduce a voltage drop, if any, caused by the transparent electrodes 11*a* and 12*a* having a high resistance.

Each of the plurality of electrode pairs may include the bus electrodes 11*b* and 12*b* only. In this case, the manufacturing cost of the PDP may decrease due to not using the transparent electrodes 11*a* and 12*a*. The bus electrodes 11*b* and 12*b* may be formed of various materials other than those set forth herein. For example, the bus electrodes 11*b* and 12*b* may be formed of a photosensitive material.

Black matrices may be formed on the upper substrate 10. The black matrices may perform a light shied function by absorbing external light incident upon the upper substrate 10 so as to reduce the reflection of light. In addition, the black matrices may enhance the purity and contrast of the upper substrate 10.

More specifically, the black matrices may include a first black matrix 15 which overlaps a plurality of barrier ribs 21, a second black matrix 11*c* which is formed between the transparent electrode 11*a* and the bus electrode 11*b*, and a second black matrix 12*c* which is formed between the transparent electrode 12*a* and the bus electrode 12*b*. The first black matrix 15 and the second black matrices 11*c* and 12*c*, which are also referred to as black layers or black electrode layers, may be formed at the same time and may be physically connected to each other. Alternatively, the first black matrix 15 and the second black matrices 11*c* and 12*c* may not be formed at the same time, and may be physically isolated from each other.

When the first black matrix 15 and the second black matrices 11*c* and 12*c* are physically connected to each other, the first black matrix 15 and the second black matrices 11*c* and 12*c* may be formed of the same material. On the other hand, when the first black matrix 15 and the second black matrices 11*c* and 12*c* are physically isolated from each other, the first black matrix 15 and the second black matrices 11*c* and 12*c* may be formed of different materials.

An upper dielectric layer 13 and a passivation layer 14 may be deposited on the upper substrate 10 on which the scan electrodes 11 and the sustain electrodes 12 are formed in parallel with one other. Charged particles resulting from a discharge operation may accumulate in the upper dielectric layer 13. The upper dielectric layer 13 may protect the plurality of electrode pairs. The passivation layer 14 may protect the upper dielectric layer 13 against the sputtering of charged particles and may enhance the discharge of secondary electrons.

The address electrodes 22 may intersect the scan electrode 11 and the sustain electrodes 12. A lower dielectric layer 24 and the barrier ribs 21 may be formed on the lower substrate 20 on which the address electrodes 22 are formed.

A phosphor layer may be formed on the lower dielectric layer 24 and the barrier ribs 21. The barrier ribs 21 may include a plurality of vertical barrier ribs 21*a* and a plurality of horizontal barrier ribs 21*b*, and may thus form a closed-type barrier rib structure. The barrier ribs 21 may define a plurality of discharge cells and may prevent ultraviolet (UV) rays and visible rays resulting from a discharge operation from infiltrating into the discharge cells.

The present invention can be applied to various barrier rib structures, other than that set forth herein. For example, the present invention can be applied to a differential barrier rib structure in which the height of vertical barrier ribs 21*a* is different from the height of horizontal barrier ribs 21*b*, a channel-type barrier rib structure in which at least one of the vertical or horizontal barrier ribs 21*a* or 21*b* has a channel that can be used as an exhaust passage, and a hollow-type barrier rib structure in which at least one of the vertical or horizontal barrier ribs 21*a* or 21*b* has a hollow. In the differential barrier rib structure, the horizontal barrier ribs 21*b* may be taller than the vertical barrier ribs 21*a*. In the channel-type barrier rib structure or the hollow-type barrier rib structure, at least one of the horizontal barrier ribs 21*b* may have a channel or a hollow.

Red (R), green (G), and blue (B) discharge cells may be arranged in line. However, the present invention is not restricted to this. That is, R, G, and B discharge cells may be arranged in various manners, other than that set forth herein. For example, a group of R, G and B discharge cells may be arranged in a polygonal pattern such as a triangular, rectangular, pentagonal or hexagonal pattern.

The phosphor layer may be excited by UV rays generated by a gas discharge. As a result, the phosphor layer may generate one of R, G, and B rays. A discharge space may be provided between the upper and lower substrates 10 and 20 and the barrier ribs 21. A mixture of inert gases, e.g., a mixture of helium (He) and xenon (Xe), a mixture of neon (Ne) and Xe, or a mixture of He, Ne, and Xe may be injected into the discharge space.

Figure 2:
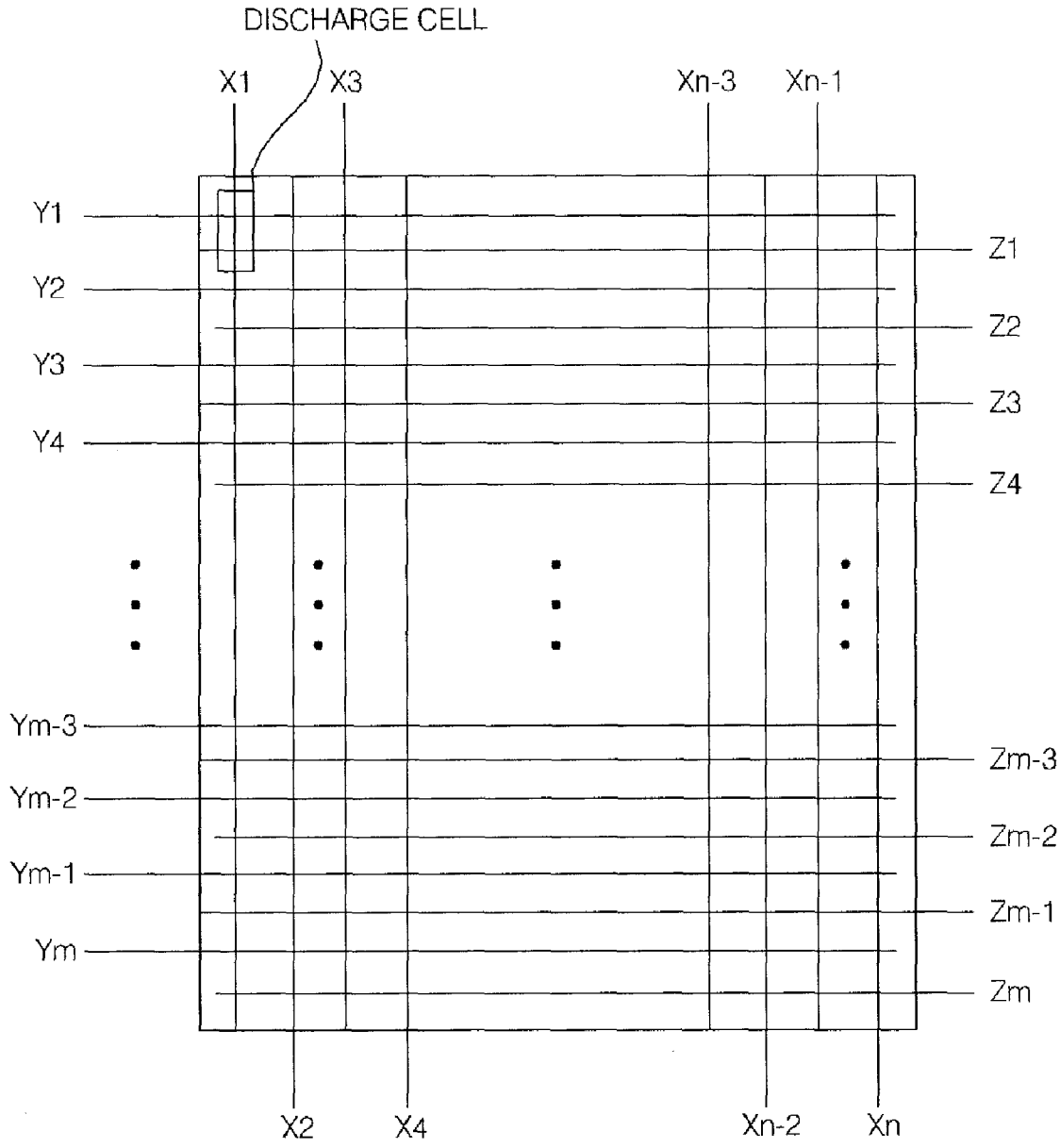
FIG. 2 illustrates a cross-sectional view of the PDP shown in FIG. 1 for explaining the arrangement of electrodes in a PDP.

FIG. 2 illustrates the arrangement of electrodes in a PDP. Referring to FIG. 2, a plurality of discharge cells of a PDP may be arranged in a matrix. The discharge cells are respectively disposed at the intersections between a plurality of scan electrode lines $Y_1$ through $Y_m$ and a plurality of address electrode lines $X_1$ through $X_n$ or the intersections between a plurality of sustain electrode lines $Z_1$ through $Z_m$ and the address electrode lines $X_1$ through X. The scan electrode lines $Y_1$ through $Y_m$ may be sequentially or simultaneously driven. The sustain electrode lines $Z_1$ through $Z_m$ may be simultaneously driven. The address electrode lines $X_1$ through $X_n$ may be divided into two groups: a group including odd-numbered address electrode lines and a group including even-numbered address electrode lines. The address electrode lines $X_1$ through $X_n$ may be driven in units of the groups or may be sequentially driven.

The electrode arrangement illustrated in FIG. 2, however, is exemplary, and thus, the present invention is not restricted to this. For example, the scan electrode lines $Y_1$ through $Y_m$ may be driven using a dual scan method in which two of a plurality of scan lines are driven at the same time. The address electrode lines $X_1$ through $X_n$ may be divided into two groups: a group including a number of upper address electrode lines disposed in the upper half of a PDP and a group including a number of lower address electrode lines disposed in the lower half of the PDP. Then, the address electrode lines $X_1$ through $X_n$ may be driven in units of the two groups.

Figure 3:
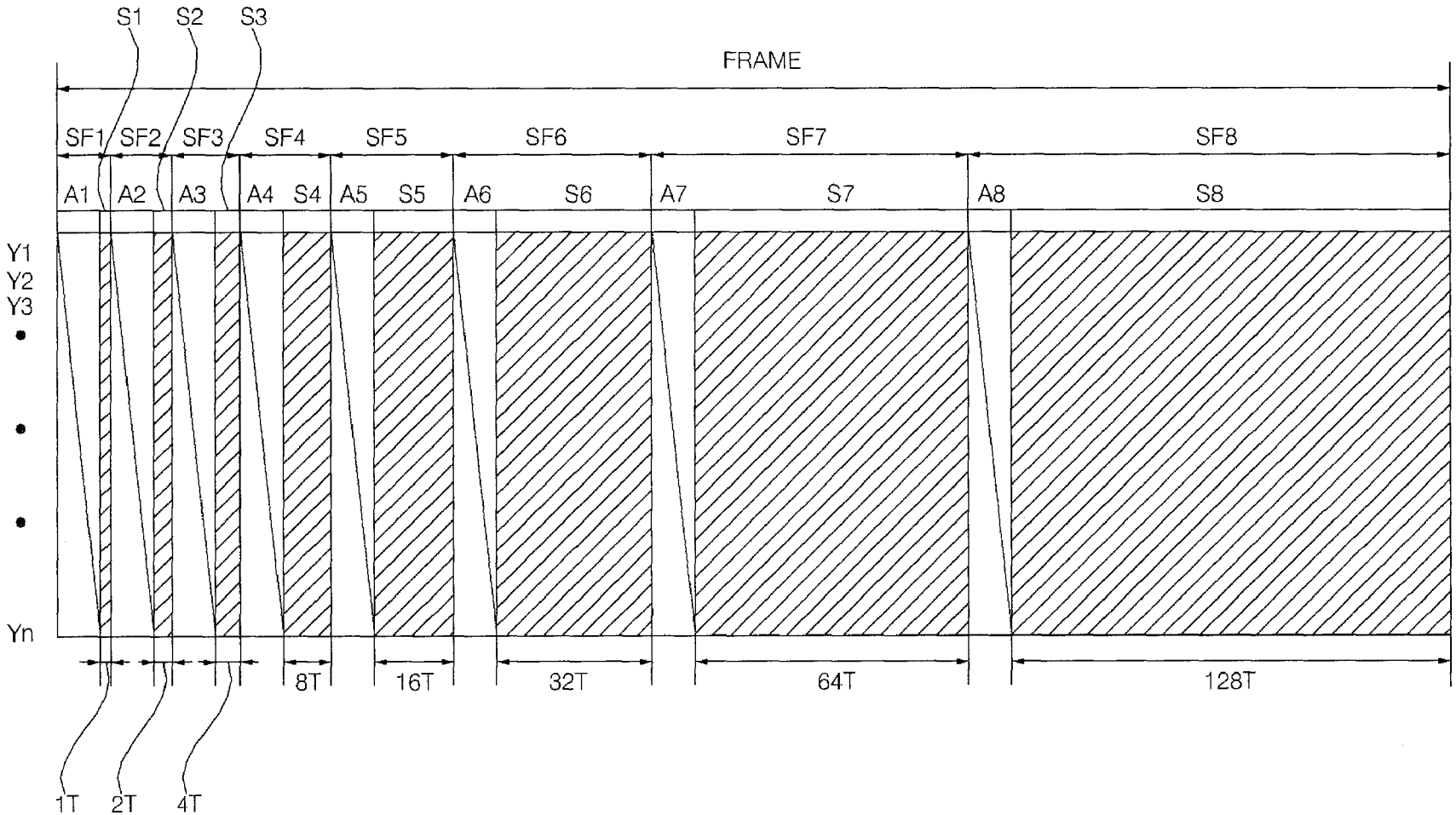
FIG. 3 illustrates a timing diagram for explaining a time-division method for driving a PDP in which a frame is divided into a plurality of subfields.

FIG. 3 illustrates a timing diagram for explaining a time-division method of driving a PDP in which a frame is divided into a plurality of subfields. Referring to FIG. 3, a unit frame may be divided into a predefined number of subfields, for example, eight subfields SF1 through SF8, in order to realize a time-division grayscale display. Each of the subfields SF1 through SF8 may be divided into a reset period (not shown), an address period (A1, . . . , A8), and a sustain period (S1, . . . , S8).

Some of the subfields SF1 through SF8 may have a reset period. For example, the first subfield SF1 may have a reset period. Alternatively, the first subfield and any subfield in the middle of the frame may both have a reset period.

During each of the address periods A1 through A8, a display data signal may be applied to address electrodes X, and a scan pulse may be applied to scan electrodes Y. As a result, a number of wall charges may be generated in discharge cells.

During each of the sustain periods S1 through S8, a number of sustain pulses may be alternately applied to the scan electrodes Y and sustain electrodes Z. As a result, a number of sustain discharges may be generated in discharge cells.

The luminance of a PDP may be proportional to the total number of sustain discharge pulses applied during each frame. If each frame includes eight subfields and can be represented using 256 grayscale levels, 1, 2, 4, 8, 16, 32, 64, and 128 sustain pulses may be configured to be applied during the sustain periods S1, S2, S3, S4, S5, S6, S7, and S8, respectively. In this case, a grayscale level of 133 may be realized by addressing a discharge cell may be addressed during the first, third, and eighth subfields SF1, SF3, and SF8, respectively, so as to cause a total of 133 sustain discharges.

The number of sustain discharges that can be applied during each of the subfields SF1 through SF8 may be determined by a weight applied to a corresponding subfield through automatic power control (APC). Referring to FIG. 3, each frame may be divided into eight subfields, but the present invention is not restricted to this. In other words, each frame may be divided into less than eight or more than eight subfields (e.g., twelve or sixteen subfields).

The number of sustain discharges that can be applied during each of the subfields SF1 through SF8 may be determined by the properties of a PDP such as a gamma property. For example, the subfield SF4 may be configured to realize a grayscale level of 6, instead of a grayscale level of 8, and the subfield SF6 may be configured to realize a grayscale level of 34, instead of a grayscale level of 32.

Figure 4:
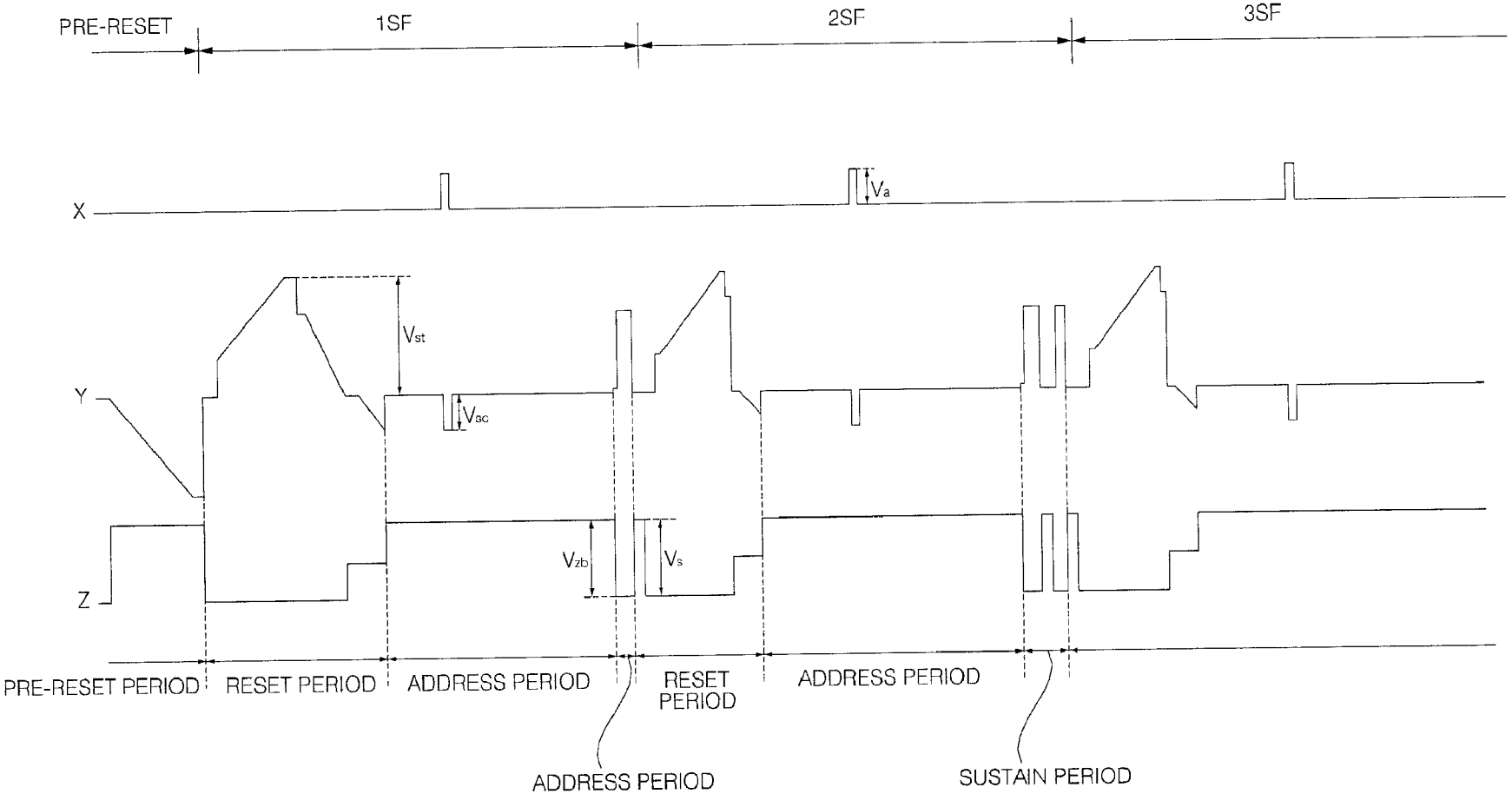
FIG. 4 illustrates a timing diagram of the waveforms of a plurality of driving signals for driving a PDP according to an exemplary embodiment of the present invention.

FIG. 4 illustrates a timing diagram of the waveforms of driving signals for driving a PDP, according to an embodiment of the present invention. Referring to FIG. 4, a pre-reset period may be followed by a first subfield 1SF. During the pre-reset period, positive wall charges may be generated on scan electrodes Y and negative wall charges are generated on sustain electrodes Z. Each of a plurality of subfields, including the first subfield 1SF, may include a reset period for initializing the discharge cells of a previous frame in consideration of the distribution of wall charges generated during the pre-reset period, an address period for selecting a number of discharge cells, and a sustain period for enabling the selected discharge cells to cause a number of sustain discharges.

The reset period may include a set-up period during and a set-down period. During the set-up period, a ramp-up signal may be applied to all the scan electrodes Y at the same time so that all the discharge cells can cause a weak discharge, and that wall charges can be generated in each of the discharge cells.

During the set-down period, a ramp-down signal whose level decreases from a positive voltage lower than the peak level of the ramp-down signal may be applied to all the scan electrodes Y so that each of the discharge cells can cause an erase discharge, and that whichever of space charges and the wall charges generated during the set-up period are unnecessary can be erased.

During the address period, a scan signal having a negative scan voltage Vsc may be sequentially applied to the scan electrodes Y, and a positive data signal may be applied to the address electrodes X. Due to the difference between the scan signal and the data signal and the wall charges generated during the reset period, an address discharge operation may occur, and a number of discharge cells may be selected. In order to improve the efficiency of the address discharge operation, a sustain bias voltage Vzb may be supplied to the sustain electrodes Z during an address period.

During the address period, the scan electrodes Y may be divided into two or more groups, and a scan signal may be sequentially applied to the groups. Each of the groups may be divided into two or more sub-groups, and a scan signal may be sequentially applied to the sub-groups. For example, the scan electrodes Y may be divided into a first group and a second group, and a scan signal may be sequentially applied to a number of scan electrodes Y included in the first group. Thereafter, a scan signal may be sequentially applied to a number of scan electrodes Y included in the second group.

More specifically, the scan electrodes Y may be divided into a first group including a plurality of even-numbered scan electrodes Y and a second group including a plurality of odd-numbered scan electrodes Y. Alternatively, the scan electrodes Y may be divided into a first group including a plurality of upper scan electrodes Y and a second group including a plurality of lower scan electrodes Y.

Thereafter, the scan electrodes included in the first group may be divided into a first sub-group including a plurality of even-numbered scan electrodes Y and a second sub-group including a plurality of odd-numbered scan electrodes Y or a first sub-group including a plurality of upper scan electrodes Y and a second sub-group including a plurality of lower scan electrodes Y.

During the sustain period, one or more sustain signals may be alternately applied to the scan electrodes Y and the sustain electrodes Z so that surface discharges can occur between the scan electrodes Y and the sustain electrodes Z as sustain discharges. Of the sustain signals, the first or last sustain signal may have a larger pulse width than the sustain signal(s) in the middle.

Each of the plurality of subfields including the first subfield 1SF may also include an erase period that follows the sustain period. During the erase period, wall charges remained, even after a sustain discharge operation, in the scan electrodes Y or the sustain electrodes Z of the discharge cells (i.e., on cells) selected during the address period may be erased by causing weak discharges.

Some of the plurality of subfields including the first subfield 1SF may not include the erase period. During the erase period, an erase signal for causing weak discharges may be applied to whichever of the scan electrodes Y and the sustain electrodes Z are not supplied with the last sustain signal applied during the sustain period.

A ramp-up signal whose level gradually increases, a low-voltage wide pulse signal, a high-voltage narrow pulse signal, a exponential signal whose level increases exponentially or a half-sinusoidal pulse signal may be used as the erase signal.

In order to cause weak discharges during the erase period, a plurality of pulses may be sequentially applied to the scan electrodes Y or the sustain electrodes Z.

The waveforms shown in FIG. 4 are exemplary, and thus, the present invention is not restricted thereto. For example, the pre-reset period may be optional. In addition, the polarities and the voltages of driving signals for driving a PDP are not restricted to those illustrated in FIG. 4, and may be altered in various manners. The erase signal for erasing wall charges may be applied to the sustain electrodes Z when a sustain discharge operation is complete. During the sustain period, one or more sustain signals may be applied only to the scan electrodes Y or the sustain electrodes Z, thereby realizing single-sustain driving. The scan electrodes Y may be divided into two or more groups and may thus be driven in units of the groups.

Meanwhile, the various driving signals shown in FIG. 4 may be applied to the scan electrodes, the sustain electrodes and the address electrodes by a driver (not shown). The driver in the present invention may mean a scan driver applying driving signals to the scan electrodes or a sustain driver applying driving signals to the sustain electrodes or an address driver applying driving signals to the address electrodes.

Figure 5:
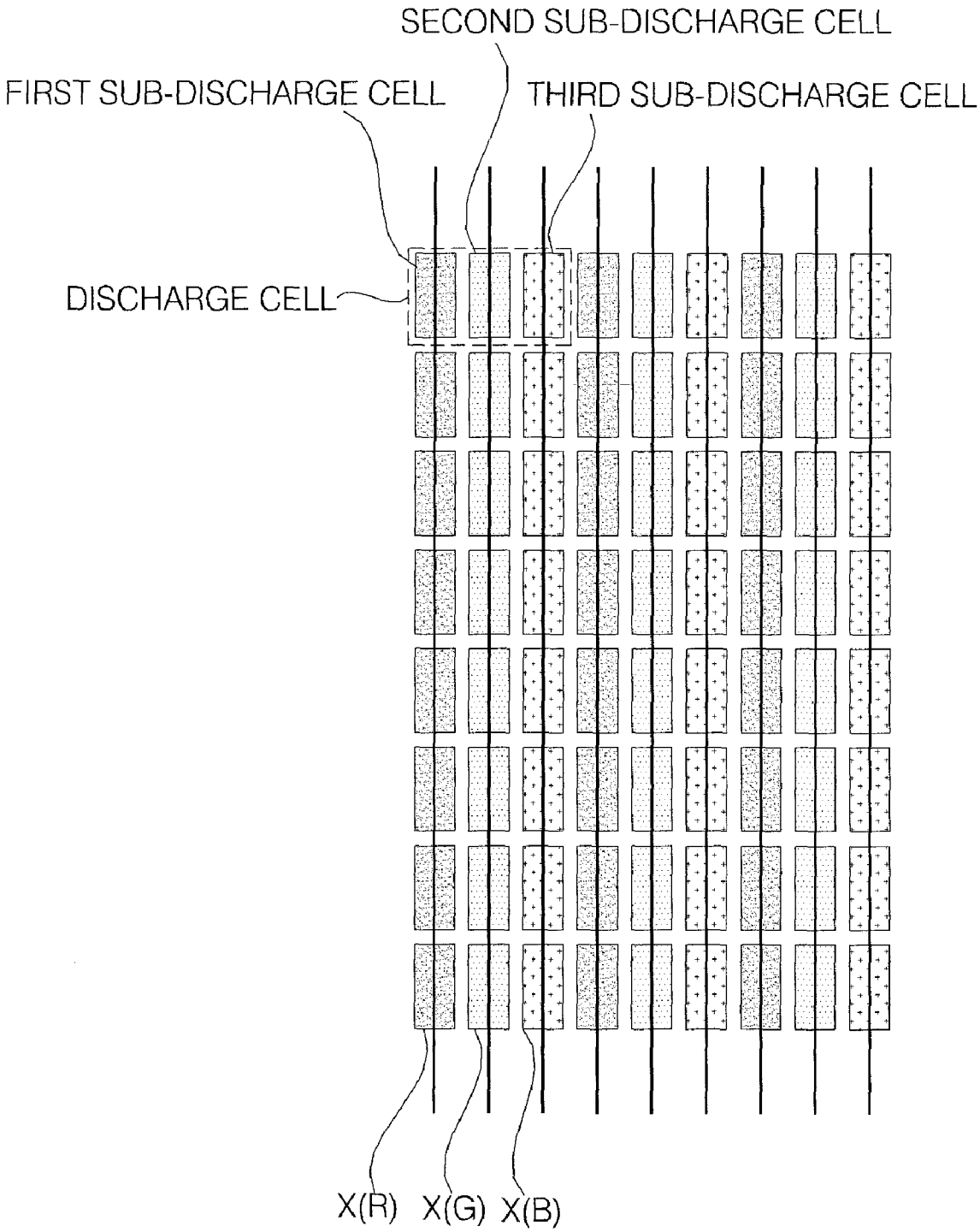
FIG. 5 illustrates the structure of discharge cells shown in FIG. 2.

FIG. 5 illustrates the structure of the discharge cells shown in FIG. 2. Referring to FIG. 5, each of the discharge cells shown in FIG. 2 may include a plurality of sub-discharge cells. Each of the sub-discharge cells may include one of R, G and B phosphors and may thus be classified into an R, G or B sub-discharge cell. Referring to FIG. 5, each of the discharge cells shown in FIG. 2 may include first, second and third sub-discharge cells, and red, green and blue electrodes X(R), X(G), and X(B) may be included in the first, second and third sub-discharge cells, respectively. Each of the sub-discharge cells may also include, for example, a white (W) phosphor, in addition to an R, G or B phosphor.

Figure 6:
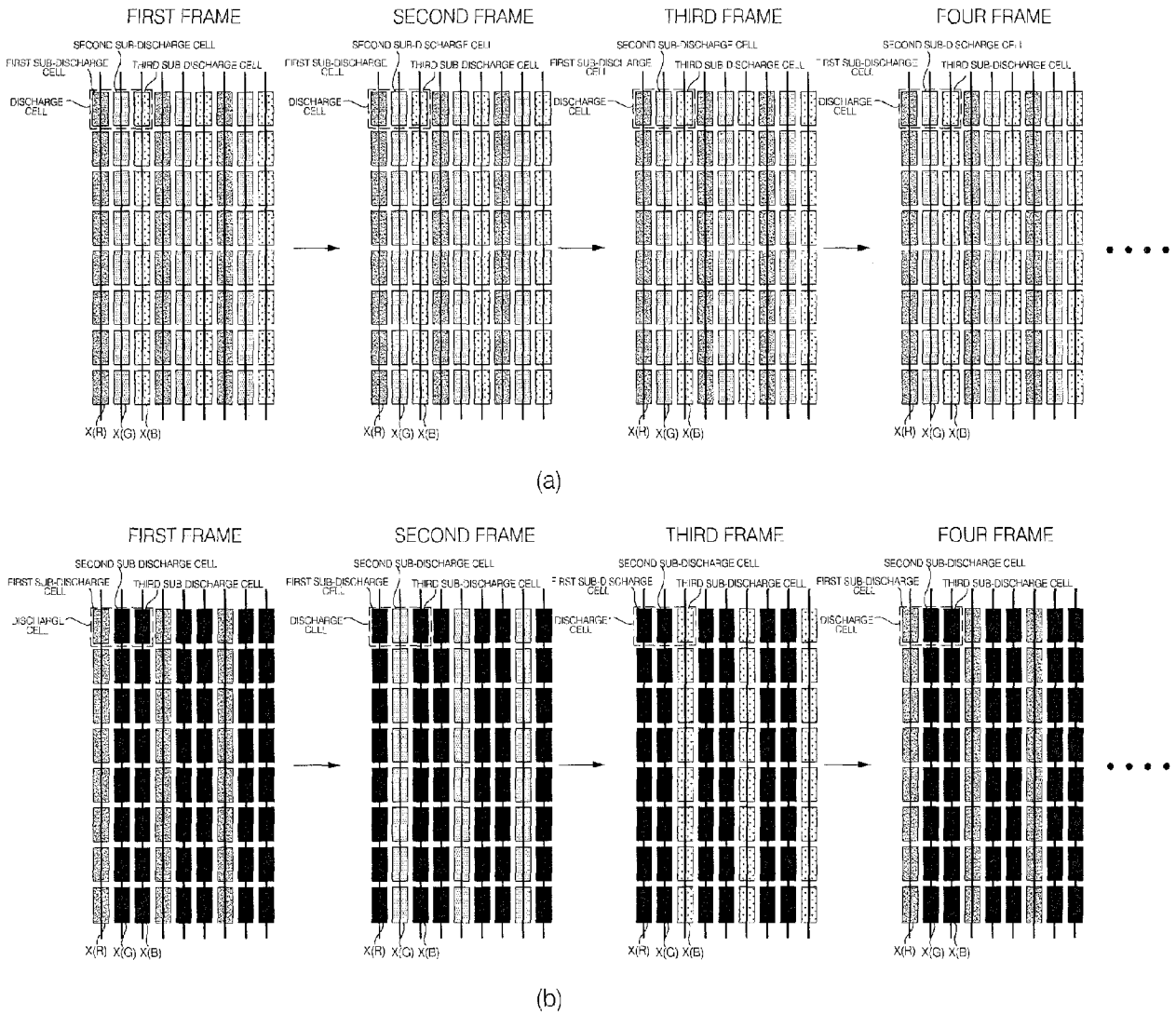
FIG. 6 illustrates how to perform a reset discharge operation alternately in a plurality of sub-discharge cells of each discharge cell on a frame-by-frame basis.

FIG. 6 illustrates how to perform a reset discharge operation alternately in a plurality of sub-discharge cells of each discharge cell on a frame-by-frame basis. More specifically, FIG. 6(*a*) illustrates a case in which a reset discharge operation is performed in all the sub-discharge cells of each discharge cell during each of first through fourth frames. Referring to FIG. 6(*a*), during a reset period of the first frame, a reset discharge operation may be performed in each of first through third sub-discharge cells (i.e., R, G and B sub-discharge cells) of each discharge cell at the same time. Likewise, during a reset period of the second, third or fourth frame, a reset discharge operation may be performed in each of the first through third sub-discharge cells of each discharge cell at the same time. Since a reset discharge operation is performed in all the sub-discharge cells of each discharge cell, there is a clear limit in reducing the dark area luminance of a PDP.

FIG. 6(*b*) illustrates a case in which a reset discharge operation is performed in only one of the sub-discharge cells of each discharge cell during each of the first through fourth frames. Referring to FIG. 6(*b*), during the reset period of the first frame, a reset discharge operation may be performed in the first sub-discharge cell (i.e., an R sub-discharge cell) of each discharge cell. During the reset period of the second frame, a reset discharge operation may be performed in the second sub-discharge cell (i.e., a G sub-discharge cell) of each discharge cell. During the reset period of the third frame, a reset discharge operation may be performed in the third sub-discharge cell (i.e., a B sub-discharge cell) of each discharge cell. During the reset period of the fourth frame, a reset discharge operation may be performed again in the first sub-discharge cell of each discharge cell. That is, a reset discharge operation may be performed in a plurality of sub-discharge cells of each discharge cell on a frame-by-frame basis. In short, referring to FIG. 6(*b*), a reset discharge operation may be performed alternately in different discharge cells of each discharge cell during different frames. Thus, the dark area luminance of a PDP can be reduced to about 1/3 and the dark room contrast ratio of a PDP can be tripled, compared to the method shown in FIG. 6(*a*).

Figure 7:
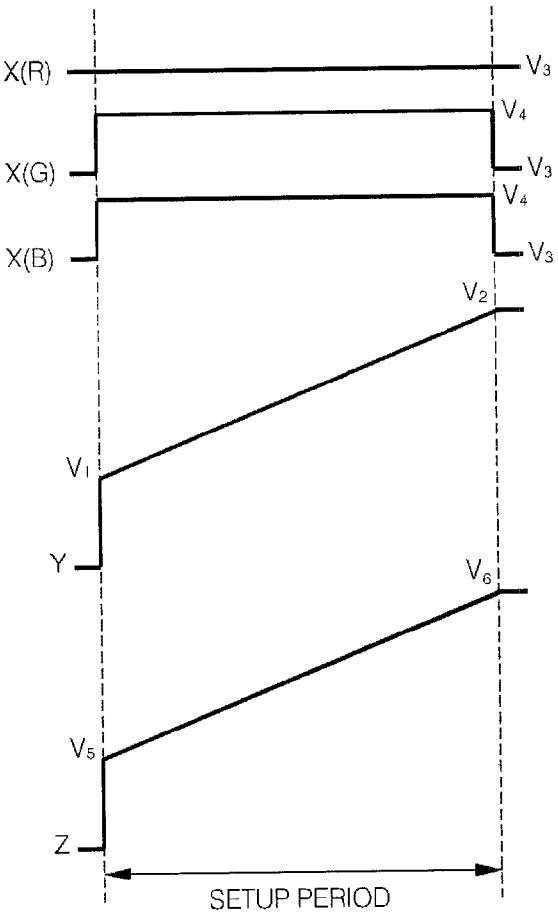
FIGS. 7 through 9 illustrate how to perform a reset discharge operation according to an embodiment of the present invention.
Figure 7:
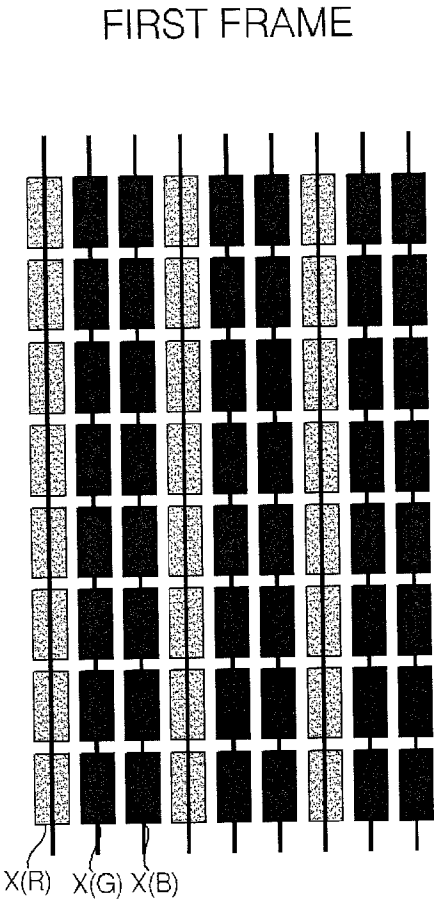
Figure 8:
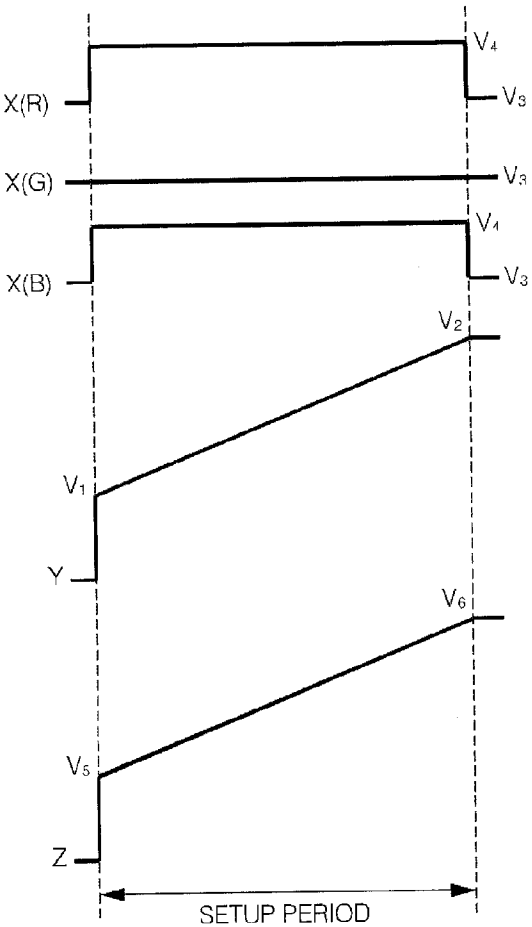
Figure 8:
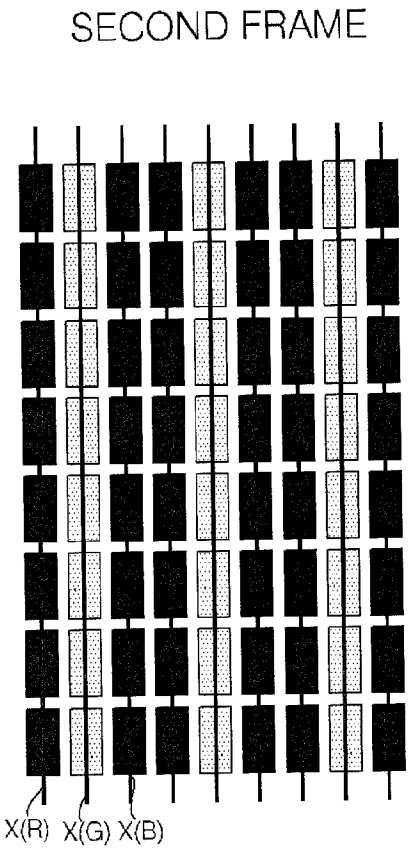
Figure 9:
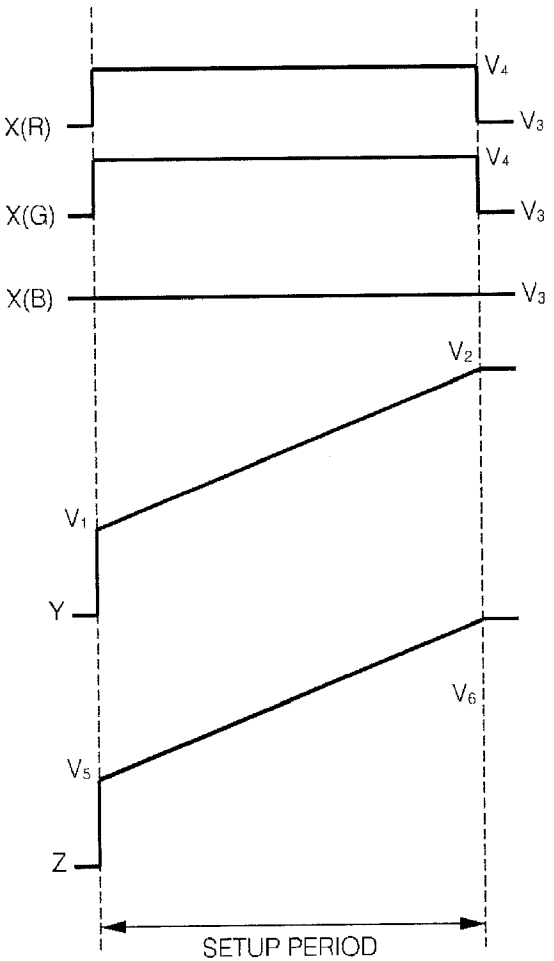
Figure 9:
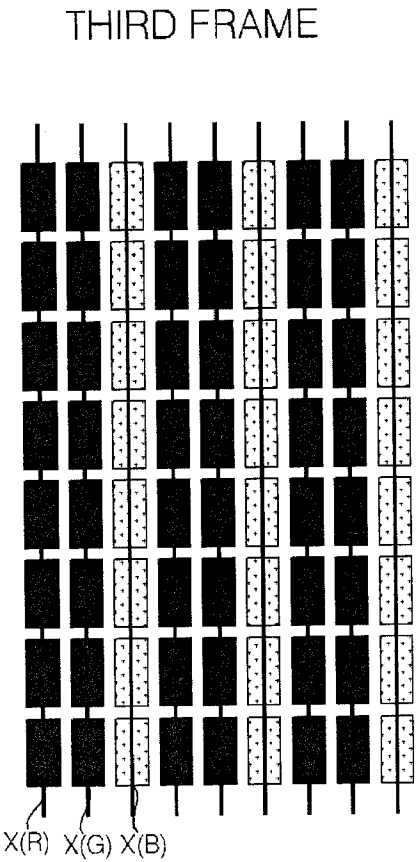

FIGS. 7 through 9 illustrate diagrams for explaining how to perform a reset discharge operation according to an exemplary embodiment of the present invention.

More specifically, FIG. 7 illustrates the waveforms of various driving signals applied to various electrodes (i.e., a plurality of scan electrodes Y, a plurality of red address electrodes X(R), a plurality of green address electrodes X(G), a plurality of red address electrodes X(B) and a plurality of sustain electrodes Z) of a PDP for causing a reset discharge in a first sub-discharge cell (i.e., an R sub-discharge cell) of each of a plurality of discharge cells during a first frame. Referring to FIG. 7, the first frame may include a plurality of sub-fields, and a reset period of one of the sub-fields may include a setup period for applying a setup signal to the scan electrodes Y. The level of the setup signal is illustrated in FIG. 7 as gradually increasing during the setup period of the first frame, but the present invention is not restricted to this. That is, the setup signal may have various waveforms other than that set forth herein. The first voltage $V_1$ may be the same as a sustain voltage Vs, which is the voltage of a sustain pulse, and the second voltage $V_2$ may be the same as the result of adding up a scan voltage Vsc and the sustain voltage Vs. A ramp-up signal is illustrated as being applied to the scan electrodes Y during the setup period of the first frame, but the present invention is not restricted to this. That is, various signals other than a typical ramp-up signal, such as a ramp-up signal with multiple slopes and a parabolic signal, may be applied to the scan electrodes Y during the setup period of the first frame.

In order to cause a reset discharge in the first sub-discharge cell of each of the discharge cells during the setup period of the first frame, a third voltage $V_3$ may be supplied to the red address electrodes X(R) corresponding to the first sub-discharge cell of each of the discharge cells, and a fourth voltage $V_4$, which is a positive voltage higher than the third voltage $V_3$, may be supplied to the green address electrodes X(G) and the blue address electrodes X(B). As a result, the difference between the electric potential of the scan electrodes Y and the electric potential of the red address electrodes X(R) may become higher than a reset-discharge-initiation voltage, which is a voltage required to initiate a reset discharge, and the difference between the electric potential of the green address electrodes X(G) and the blue address electrodes X(B) may become lower than the reset-discharge-initiation voltage. The third voltage $V_3$ may be a ground voltage VG, and the fourth voltage $V_4$ may be the same as the level of a data signal applied during an address period of the first frame.

The fourth voltage $V_4$ is illustrated in FIG. 7 as being applied throughout the entire setup period, but the present invention is not restricted to this. That is, the fourth voltage $V_4$ may be supplied to the green address electrodes X(G) and the blue address electrodes X(B) during only part of the application of the setup signal to the scan electrodes Y so as not to cause a reset discharge.

During the setup period of the first frame, the sustain electrodes Z may be floated and may thus have almost the same electric potential as the scan electrodes Y.

Alternatively, during the setup period of the first frame, a signal similar to the setup signal, and particularly, a signal whose level gradually increases from a fifth voltage $V_5$ to a sixth voltage $V_6$ may be supplied to the sustain electrodes Z. The fifth voltage $V_5$ may be the same as the first voltage $V_1$, and the sixth voltage $V_6$ may be the same as the second voltage $V_2$.

In this manner, during the setup period of the first frame, a reset discharge may occur in the first sub-discharge cell of each of the discharge cells, and thus, red light may be emitted from the PDP. More specifically, an opposed discharge may occur between the scan electrodes Y and the red address electrodes X(R) as the reset discharge.

FIG. 8 illustrates the waveforms of various driving signals applied to the scan electrodes Y, the red address electrodes X(R), the green address electrodes X(G), the red address electrodes X(B) and the sustain electrodes Z for causing a reset discharge in a second sub-discharge cell (i.e., a G sub-discharge cell) of each of the discharge cells during a second frame. Referring to FIG. 8, during a setup period of the second frame, the third voltage $V_3$ may be supplied to the green address electrodes X(G) so as to cause a reset discharge in the second sub-discharge cell of each of the discharge cells whereas the third voltage $V_3$ is illustrated in FIG. 7 as being applied to the red address electrodes X(R) so as to cause a reset discharge in the first sub-discharge cell of each of the discharge cells. In addition, during the setup period of the second frame, the fourth voltage $V_4$, which is a positive voltage higher than the third voltage $V_3$, may be supplied to the red address electrodes X(R) and the blue address electrodes X(B). The driving signals applied to the scan electrodes Y and the sustain electrodes Z during the setup period of the second frame may be the same as their respective counterparts applied during the setup period of the first frame.

In this manner, during the setup period of the second frame, a reset discharge may occur in the second sub-discharge cell of each of the discharge cells, and thus, green light may be emitted from the PDP. More specifically, an opposed discharge may occur between the scan electrodes Y and the green address electrodes X(G) as the reset discharge.

FIG. 9 illustrates the waveforms of various driving signals applied to the scan electrodes Y, the red address electrodes X(R), the green address electrodes X(G), the red address electrodes X(B) and the sustain electrodes Z for causing a reset discharge in a third sub-discharge cell (i.e., a B sub-discharge cell) of each of the discharge cells during a third frame. Referring to FIG. 9, during a setup period of the third frame, the third voltage $V_3$ may be supplied to the blue address electrodes X(B) so as to cause a reset discharge in the third sub-discharge cell of each of the discharge cells whereas the third voltage $V_3$ is illustrated in FIG. 7 as being applied to the red address electrodes X(R) so as to cause a reset discharge in the first sub-discharge cell of each of the discharge cells. In addition, during the setup period of the third frame, the fourth voltage $V_4$, which is a positive voltage higher than the third voltage $V_3$, may be supplied to the red address electrodes X(R) and the green address electrodes X(G). The driving signals applied to the scan electrodes Y and the sustain electrodes Z during the setup period of the second frame may be the same as their respective counterparts applied during the setup period of the first frame.

In this manner, during the setup period of the third frame, a reset discharge may occur in the third sub-discharge cell of each of the discharge cells, and thus, blue light may be emitted from the PDP. More specifically, an opposed discharge may occur between the scan electrodes Y and the blue address electrodes X(B) as the reset discharge.

In the exemplary embodiment of FIGS. 7 through 9, the fourth voltage $V_4$, which can be applied to the red address electrodes X(R), the green address electrodes X(G) and the blue address electrodes X(B), may vary according to the properties of whichever of the first through third sub-discharge cells of each of the discharge cells is supplied with the fourth voltage $V_4$. More specifically, the reset-discharge-initiation voltage may vary according to the phosphor properties of the first through third sub-discharge cells of each of the discharge cells. Thus, the fourth voltage $V_4$ may be determined so as not to cause a reset discharge. That is, the higher the reset-discharge-initiation voltage, the higher the fourth voltage $V_4$.

Figure 10:
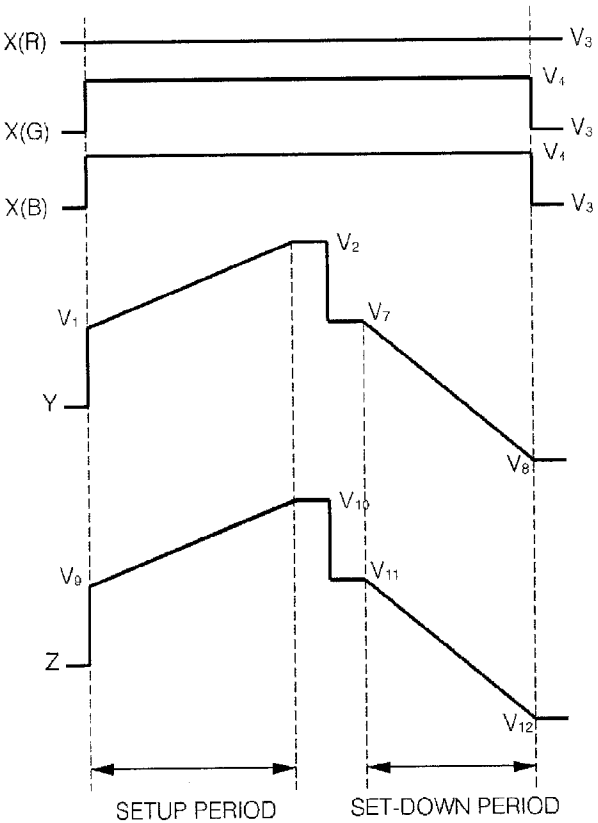
FIGS. 10 through 12 illustrate how to perform a reset discharge operation according to another embodiment of the present invention.
Figure 10:
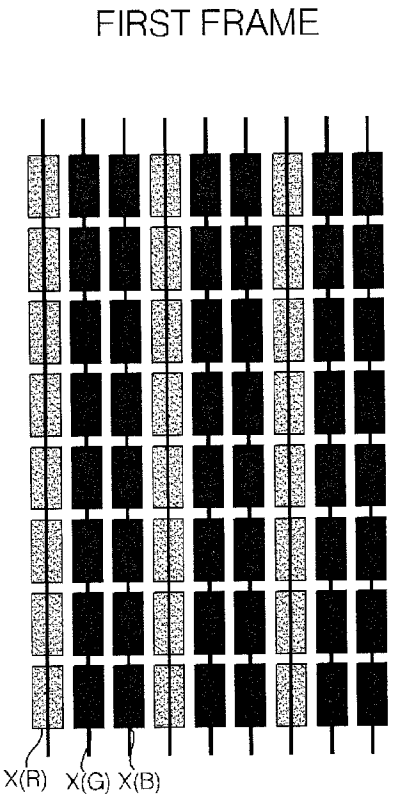
Figure 11:
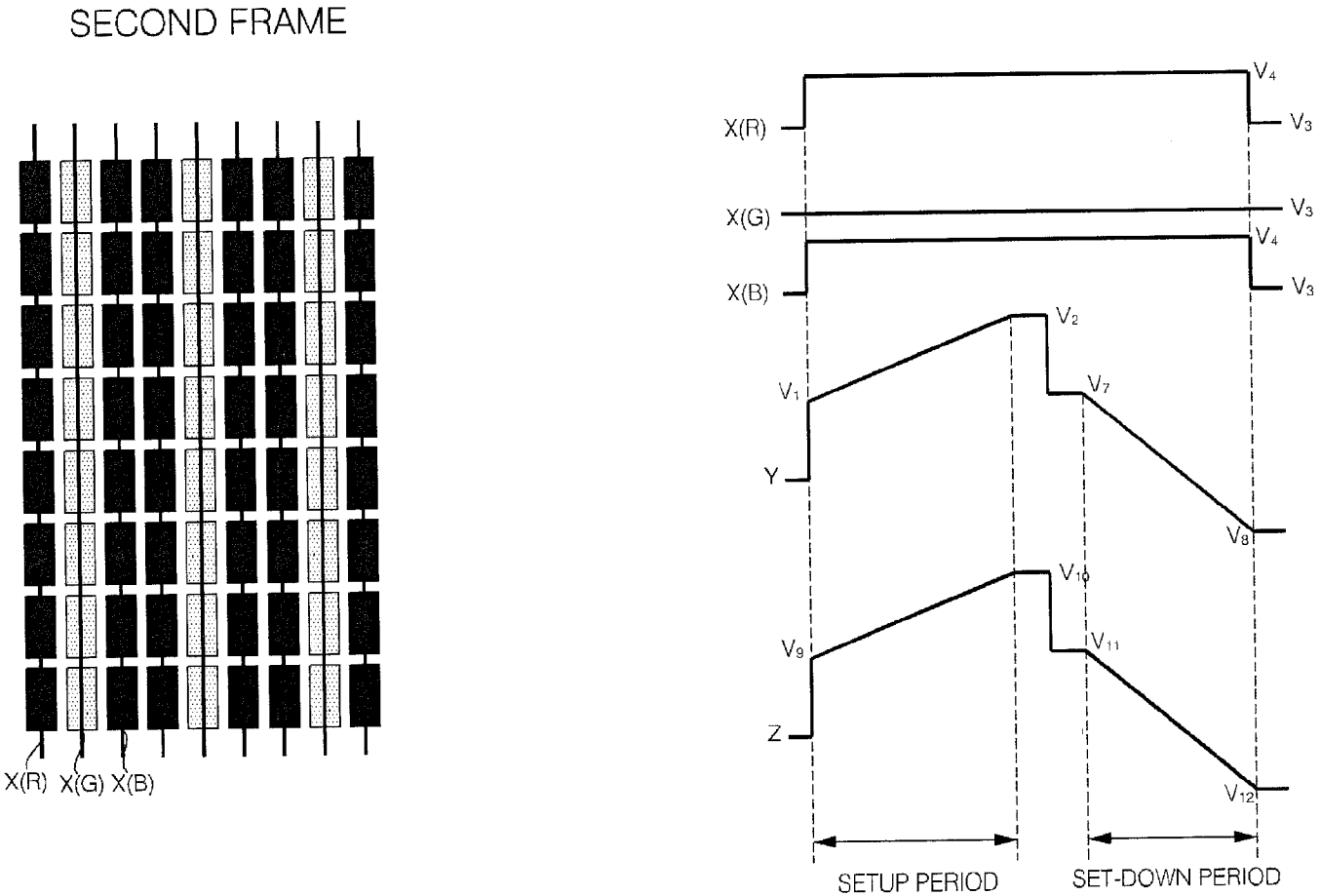
Figure 12:
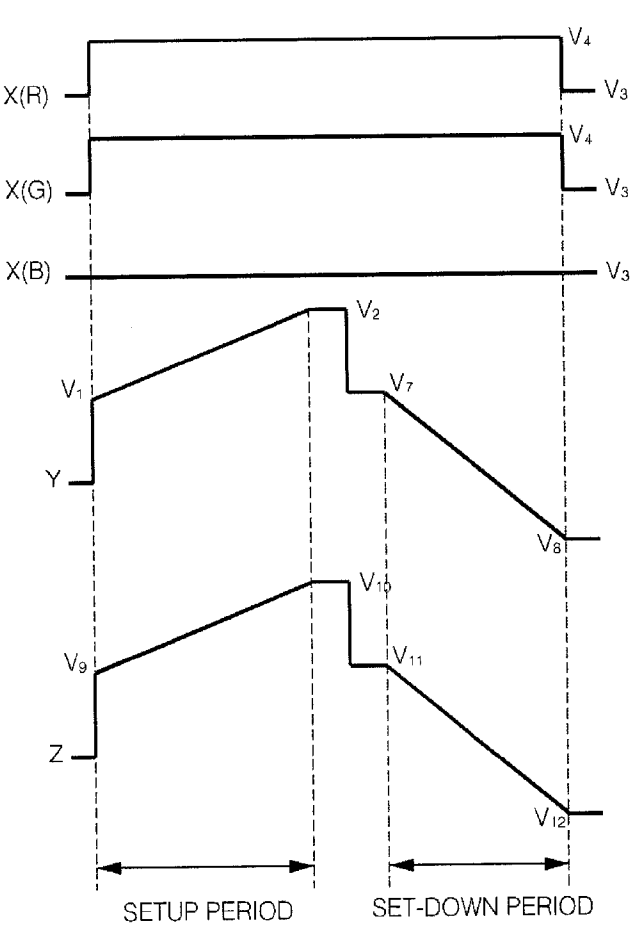
Figure 12:
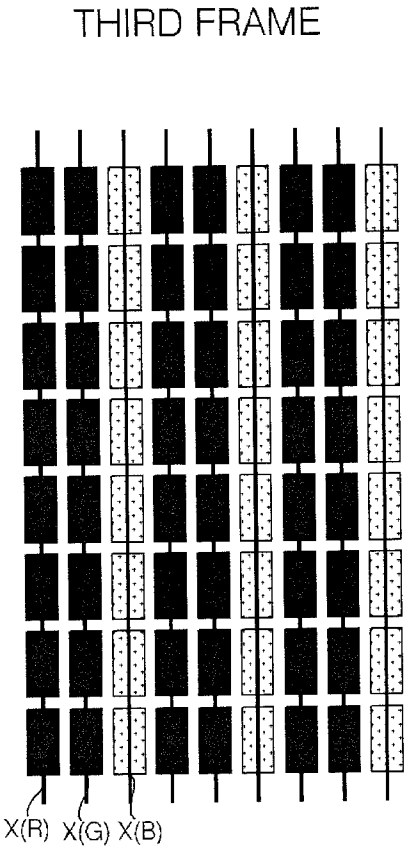

FIGS. 10 through 12 illustrate diagrams for explaining how to perform a reset discharge operation according to an exemplary embodiment of the present invention.

More specifically, FIG. 10 illustrates the waveforms of various driving signals applied to various electrodes (i.e., a plurality of scan electrodes Y, a plurality of red address electrodes X(R), a plurality of green address electrodes X(G), a plurality of red address electrodes X(B) and a plurality of sustain electrodes Z) of a PDP for causing a reset discharge in a first sub-discharge cell (i.e., an R sub-discharge cell) of each of a plurality of discharge cells during a first frame. In the exemplary embodiment of FIGS. 10 through 12, a reset period of one of a plurality of subfields of a frame may include not only a setup period for applying a setup signal whose level gradually increases from a first voltage $V_1$ to a second voltage $V_2$ to the scan electrodes Y but also a set-down period for applying a set-down signal whose level gradually decreases from a seventh voltage $V_7$ to an eighth voltage $V_8$ to the scan electrodes Y, whereas, in the exemplary embodiment of FIGS. 7 through 9, a reset period of one of a plurality of subfields of a frame includes the setup period only. The level of the setup signal is illustrated in FIG. 10 as gradually increasing during the setup period of the first frame, but the present invention is not restricted to this. That is, the setup signal may have various waveforms other than that set forth herein. Likewise, the level of the set-down signal is illustrated in FIG. 10 as gradually decreasing during the set-down period of the first frame, but the present invention is not restricted to this. That is, the set-down signal may have various waveforms other than that that set forth herein.

The first voltage $V_1$ may be the same as a sustain voltage Vs, which is the voltage of a sustain pulse, and the second voltage $V_2$ may be the same as the result of adding up a scan voltage Vsc and the sustain voltage Vs. The seventh voltage $V_7$ may be the same as the sustain voltage Vs or the scan voltage Vsc, and the eighth voltage $V_8$ may be a negative voltage.

In order to cause a reset discharge in the first sub-discharge cell of each of the discharge cells during the setup period and the set-down period of the first frame, a third voltage $V_3$ may be supplied to the red address electrodes X(R) corresponding to the first sub-discharge cell of each of the discharge cells, and a fourth voltage $V_4$, which is a positive voltage higher than the third voltage $V_3$, may be supplied to the green address electrodes X(G) and the blue address electrodes X(B). As a result, the difference between the electric potential of the scan electrodes Y and the electric potential of the red address electrodes X(R) may become higher than a reset-discharge-initiation voltage, which is a voltage required to initiate a reset discharge, and the difference between the electric potential of the green address electrodes X(G) and the blue address electrodes X(B) may become lower than the reset-discharge-initiation voltage. The third voltage $V_3$ may be a ground voltage VG, and the fourth voltage $V_4$ may be the same as the level of a data signal applied during an address period of the first frame.

During the setup period of the first frame, the sustain electrodes Z may be floated, or a signal similar to the setup signal, and particularly, a signal whose level gradually increases from a fifth voltage $V_5$ to a sixth voltage $V_6$ may be applied to the sustain electrodes Z. The fifth voltage $V_5$ may be the same as the first voltage $V_1$, and the sixth voltage $V_6$ may be the same as the second voltage $V_2$.

Similarly, during the set-down period of the first frame, the sustain electrodes Z may be floated, or a signal similar to the set-down signal, and particularly, a signal whose level gradually decreases from an eleventh voltage $V_{11}$ to a twelfth voltage $V_{12}$ may be applied to the sustain electrodes Z. The eleventh voltage $V_{11}$ may be the same as the seventh voltage $V_7$, and the twelfth voltage $V_{12}$ may be the same as the eighth voltage $V_8$.

In this manner, during the setup period of the first frame, a reset discharge may occur in the first sub-discharge cell of each of the discharge cells, and thus, red light may be emitted from the PDP. More specifically, an opposed discharge may occur between the scan electrodes Y and the red address electrodes X(R) as the reset discharge.

FIG. 11 illustrates the waveforms of various driving signals applied to the scan electrodes Y, the red address electrodes X(R), the green address electrodes X(G), the red address electrodes X(B) and the sustain electrodes Z for causing a reset discharge in a second sub-discharge cell (i.e., a G sub-discharge cell) of each of the discharge cells during a second frame. Referring to FIG. 11, during a setup period and a set-down period of the second frame, the third voltage $V_3$ may be supplied to the green address electrodes X(G) so as to cause a reset discharge in the second sub-discharge cell of each of the discharge cells whereas the third voltage $V_3$ is illustrated in FIG. 10 as being applied to the red address electrodes X(R) so as to cause a reset discharge in the first sub-discharge cell of each of the discharge cells. In addition, during the setup period and the set-down period of the second frame, the fourth voltage $V_4$, which is a positive voltage higher than the third voltage $V_3$, may be supplied to the red address electrodes X(R) and the blue address electrodes X(B). The driving signals applied to the scan electrodes Y and the sustain electrodes Z during the setup period of the second frame may be the same as their respective counterparts applied during the setup period of the first frame.

In this manner, during the setup period of the second frame, a reset discharge may occur in the second sub-discharge cell of each of the discharge cells, and thus, green light may be emitted from the PDP. More specifically, an opposed discharge may occur between the scan electrodes Y and the green address electrodes X(G) as the reset discharge.

FIG. 12 illustrates the waveforms of various driving signals applied to the scan electrodes Y, the red address electrodes X(R), the green address electrodes X(G), the red address electrodes X(B) and the sustain electrodes Z for causing a reset discharge in a third sub-discharge cell (i.e., a B sub-discharge cell) of each of the discharge cells during a third frame. Referring to FIG. 12, during a setup period and a set-down period of the third frame, the third voltage $V_3$ may be supplied to the blue address electrodes X(B) so as to cause a reset discharge in the third sub-discharge cell of each of the discharge cells whereas the third voltage $V_3$ is illustrated in FIG. 10 as being applied to the red address electrodes X(R) so as to cause a reset discharge in the first sub-discharge cell of each of the discharge cells. In addition, during the setup period and the set-down period of the third frame, the fourth voltage $V_4$, which is a positive voltage higher than the third voltage $V_3$, may be supplied to the red address electrodes X(R) and the green address electrodes X(G). The driving signals applied to the scan electrodes Y and the sustain electrodes Z during the setup period of the second frame may be the same as their respective counterparts applied during the setup period of the first frame.

In this manner, during the setup period of the third frame, a reset discharge may occur in the third sub-discharge cell of each of the discharge cells, and thus, blue light may be emitted from the PDP. More specifically, an opposed discharge may occur between the scan electrodes Y and the blue address electrodes X(B) as the reset discharge.

In the exemplary embodiments of FIGS. 7 through 9 and 10 through 12, a reset discharge operation may be performed alternately in R, G and B sub-discharge cells of each discharge cell on a frame-by-frame basis, but the present invention is not restricted to this. That is, a reset discharge operation may be performed in various orders other than that set forth herein.

Figure 13:
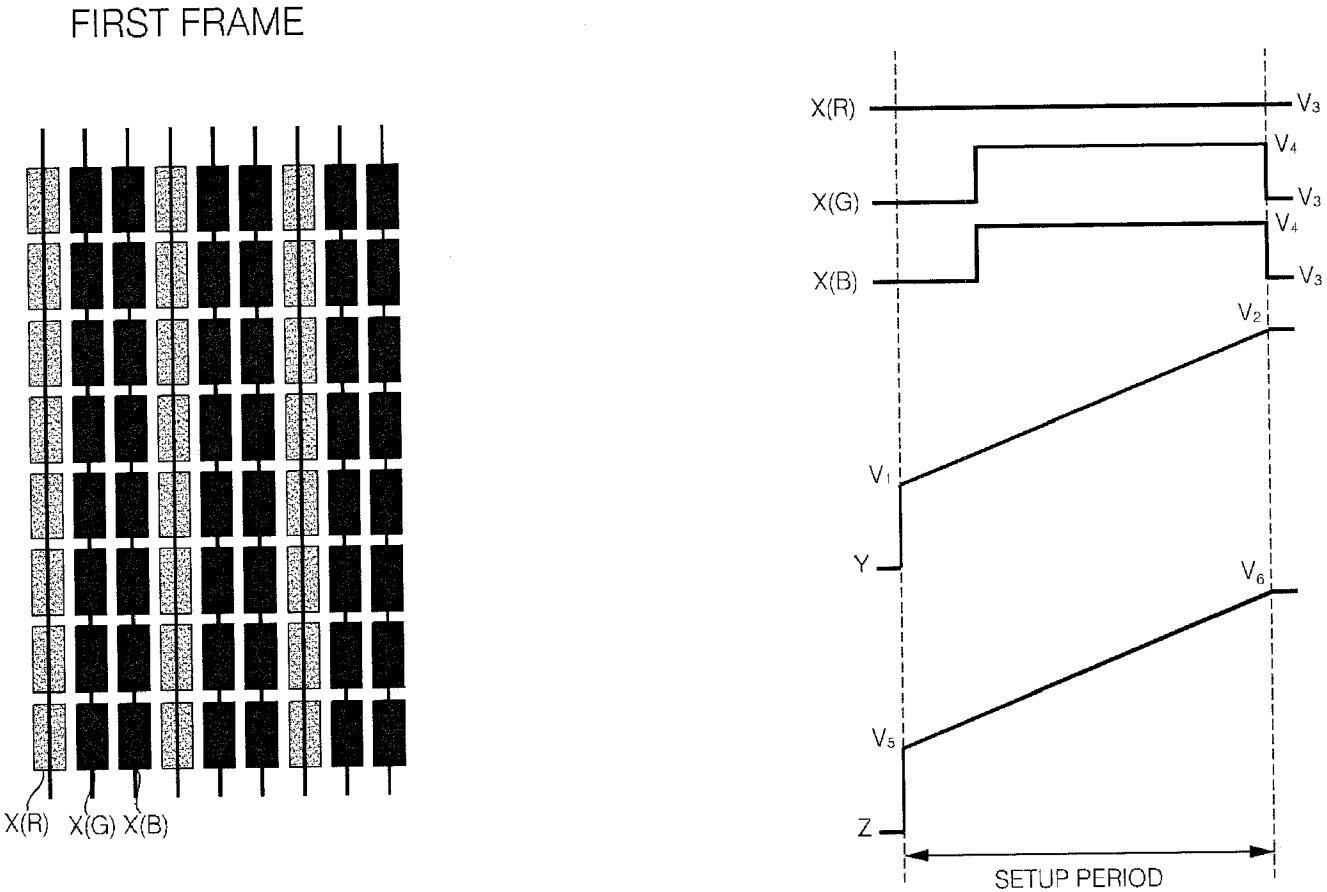
FIGS. 13 through 15 illustrate how to perform a reset discharge operation according to another embodiment of the present invention.
Figure 14:
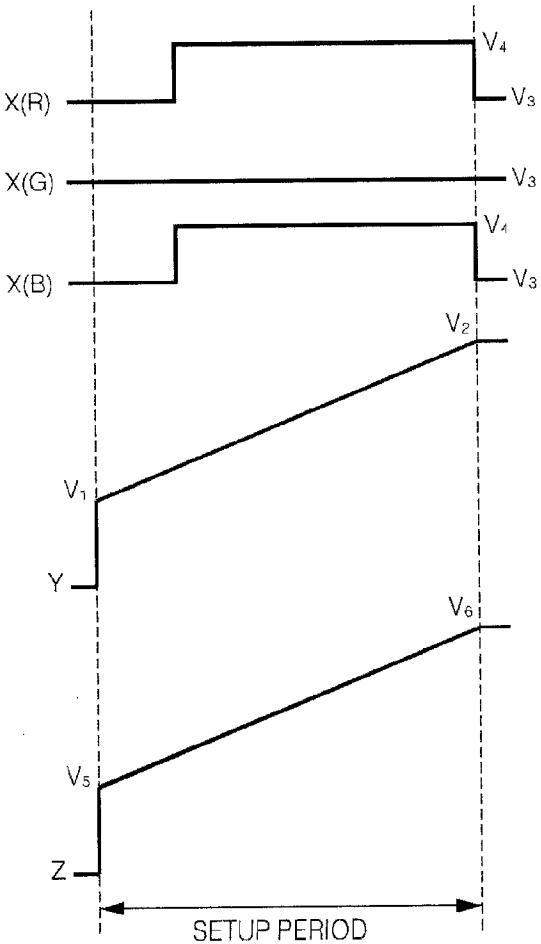
Figure 14:
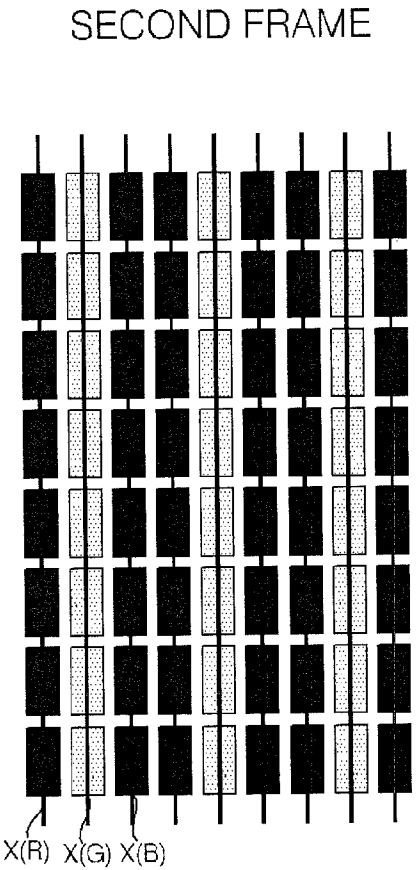
Figure 15:
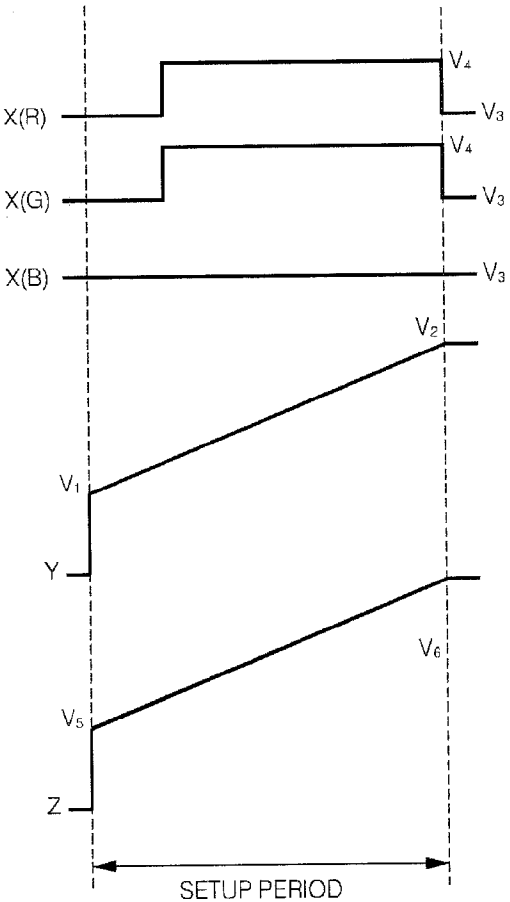
Figure 15:
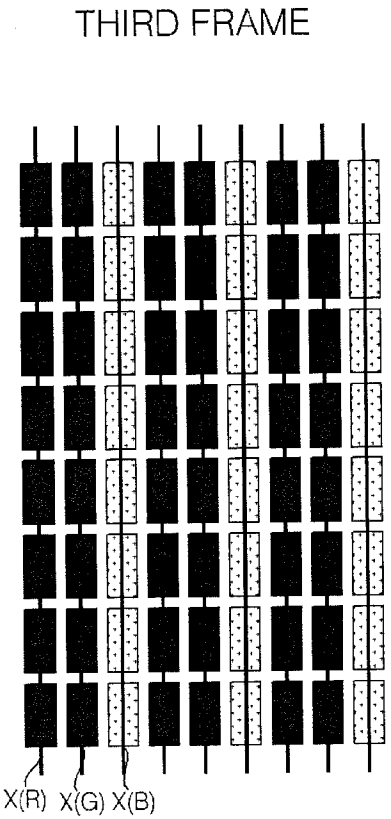

FIGS. 13 through 15 illustrate diagrams for explaining how to perform a reset discharge operation according to an exemplary embodiment of the present invention. The exemplary embodiment of FIGS. 13 through 15 is similar to the exemplary embodiment of FIGS. 7 through 9, and thus will hereinafter be described, focusing mainly on differences with the exemplary embodiment of FIGS. 7 through 9.

Referring to FIG. 13, during a setup period of a first frame, a third voltage $V_3$ may be supplied to a plurality of red address electrodes X(R) corresponding to a first sub-discharge cell of each of a plurality of discharge cells and a fourth voltage $V_4$, which is a positive voltage higher than the third voltage $V_3$, may be supplied to a plurality of green address electrodes X(G) and a plurality of blue address electrodes X(B) in order to cause a reset discharge in the first sub-discharge cell of each of the discharge cells.

The fourth voltage $V_4$ may be supplied to the green address electrodes X(G) and the blue address electrodes X(B) during the setup period of the first frame, and particularly, before the occurrence of a reset discharge.

Referring to FIG. 14, during a setup period of a second frame, the fourth voltage $V_4$ may be supplied to the red address electrodes X(R) and the blue address electrodes X(B). Referring to FIG. 15, during a setup period of a third frame, the fourth voltage $V_4$ may be supplied to the red address electrodes X(R) and the green address electrodes X(G).

Figure 16:
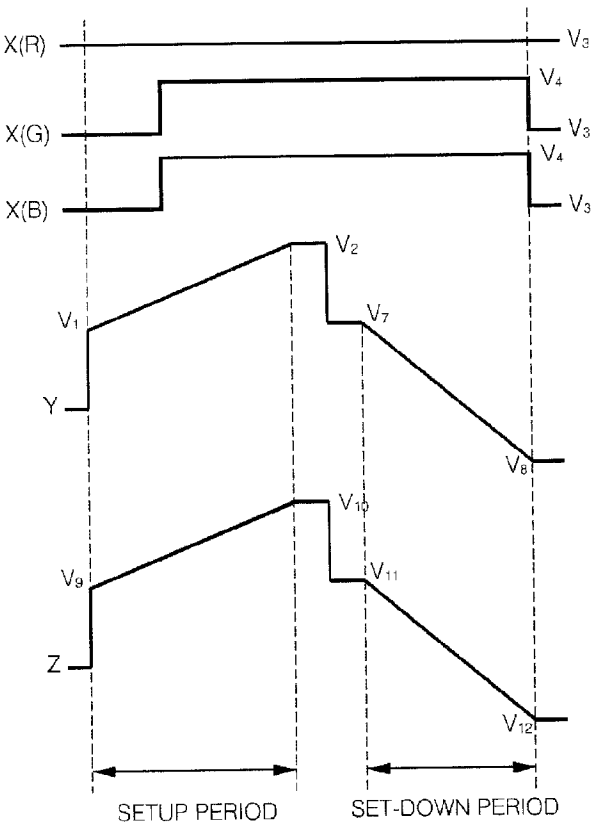
FIGS. 16 through 18 illustrate how to perform a reset discharge operation according to another embodiment of the present invention.
Figure 16:
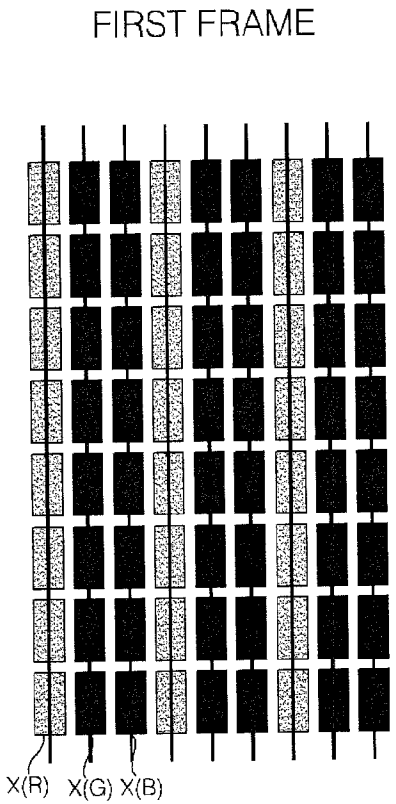
Figure 17:
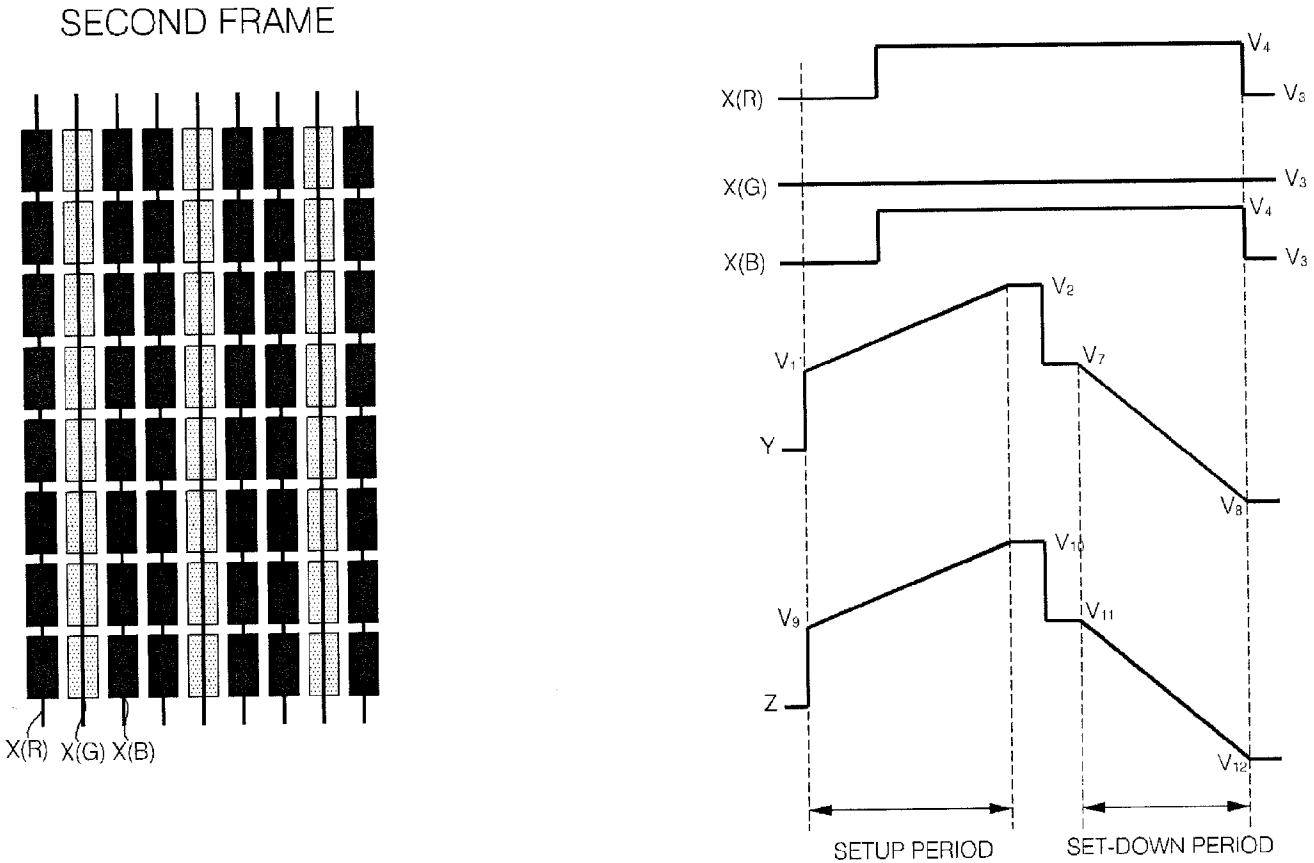
Figure 18:
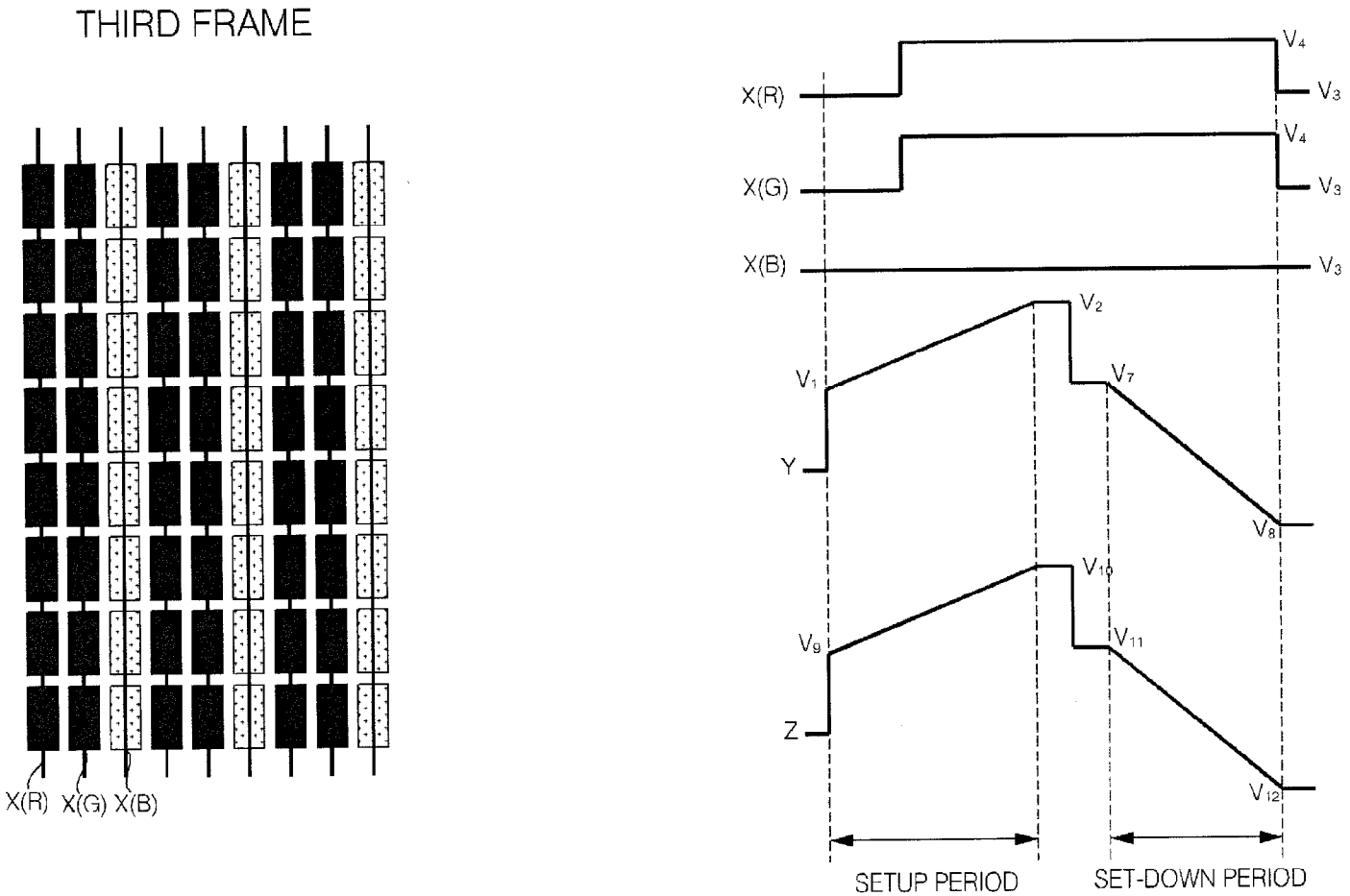

FIGS. 16 through 18 illustrate diagrams for explaining how to perform a reset discharge operation according to an exemplary embodiment of the present invention. The exemplary embodiment of FIGS. 16 through 18 is similar to the exemplary embodiment of FIGS. 10 through 12, and thus will hereinafter be described, focusing mainly on differences with the exemplary embodiment of FIGS. 10 through 12.

Referring to FIG. 16, during a setup period of a first frame, a fourth voltage $V_4$ may be supplied to a plurality of green address electrodes X(G) and a plurality of blue address electrodes X(B). Referring to FIG. 17, during a setup period of a second frame, the fourth voltage $V_4$ may be supplied to a plurality of red address electrodes X(R) and the blue address electrodes X(B). Referring to FIG. 18, during a setup period of a third frame, the fourth voltage $V_4$ may be supplied to the red address electrodes X(R) and the green address electrodes X(G).

As described above, according to the present invention, it is possible to considerably reduce the black luminance of a PDP and improve the dark-room-contrast ratio of a PDP by selectively performing a reset discharge operation in one of a plurality of sub-discharge cells of each discharge cell during each frame, instead of causing a reset discharge in all the sub-discharge cells of each discharge cell during each frame. For example, if three sub-discharge cells (R, G and B sub-discharge cells) are provided for each discharge cell, it is possible to reduce the black luminance of a PDP to about 1/3 and triple the bright-room-contrast ratio of a PDP.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display device comprising:

a plasma display panel (PDP) including an upper substrate, a lower substrate, a plurality of scan electrodes and a plurality of sustain electrodes formed on the upper substrate, and a plurality of address electrodes formed on the lower substrate; and a driver applying driving signals to the plurality of electrodes, wherein a reset discharge occurs in a part of discharge cells of a plurality of discharge cells, and wherein at least one of a plurality of subfields of a frame includes a setup period for applying a first reset signal whose level gradually increases from a first voltage to a second voltage to the plurality of scan electrodes, and during the setup period a third voltage is supplied to address electrodes corresponding to the part of discharge cells, and a fourth voltage, which is a positive higher voltage than the third voltage, is supplied to the other address electrodes of the plurality of address electrodes so as not to cause the reset discharge.

2. The plasma display device of claim 1, wherein each of the discharge cells is divided into a plurality of sub-discharge cells having different phosphors and the reset discharge occurs alternately in the plurality of sub-discharge cells of each of the discharge cells.

3. The plasma display device of claim 1, wherein the reset discharge occurs alternately in a plurality of sub-discharge cells of each of the discharge cells on a frame-by-frame basis.

4. The plasma display device of claim 1, wherein each of the discharge cells includes first, second, and third sub-discharge cells, and wherein the reset discharge occurs in the first sub-discharge cell during a first frame, in the second sub-discharge cell during a second frame, and in the third sub-discharge cell during a third frame.

5. The plasma display device of claim 1, wherein the fourth voltage varies from one sub-discharge cell to another sub-discharge cell of each of the discharge cells.

6. The plasma display device of claim 1, wherein, during the setup period, the plurality of sustain electrodes are floated.

7. The plasma display device of claim 1, wherein, during the setup period, a signal whose level gradually increases from a fifth voltage to a sixth voltage is applied to the plurality of sustain electrodes.

8. The plasma display device of claim 1, wherein the at least one of a plurality of subfields of a frame further includes a set-down period for applying a second reset signal whose level gradually decreases from a seventh voltage to an eighth voltage to the scan electrodes and a reset discharge occurs during the setup period and the set-down period.

9. The plasma display device of claim 8, wherein, during the setup period and the set-down period, the third voltage is supplied to address electrodes corresponding to whichever of the sub-discharge cells of each of the discharge cells the reset discharge is to occur in, and the fourth voltage, is supplied to the other address electrodes.

10. The plasma display device of claim 8, wherein, during the setup period and the set-down period, the plurality of sustain electrodes are floated.

11. The plasma display device of claim 8, wherein, during the setup period, a signal whose level gradually increases from a fifth voltage to a sixth voltage is applied to the plurality of sustain electrodes, and during the set-down period, a signal whose level gradually decreases from a seventh voltage to an eighth voltage is applied to the plurality of sustain electrodes.

12. A plasma display device comprising:

a plasma display panel (PDP) including an upper substrate, a lower substrate, a plurality of scan electrodes and a plurality of sustain electrodes formed on the upper substrate, and a plurality of address electrodes formed on the lower substrate; and a driver applying driving signals to the plurality of electrodes, wherein at least one of a plurality of subfields of a frame includes a setup period for applying a first reset signal whose level gradually increases from a first voltage to a second voltage to the scan electrodes, and during the setup period, a third voltage is supplied to the address electrodes corresponding to a part of discharge cells of a plurality of discharge cells, and a fourth voltage, which is a positive higher voltage than the third voltage, is supplied to the other address electrodes of the plurality of address electrodes, and wherein the at least one subfield further includes a set-down period for applying a second reset signal whose level gradually decreases from a fifth voltage to a sixth voltage to the plurality of scan electrodes, and during the setup period and the set-down period, the third voltage is supplied to the address electrodes corresponding to a first sub-discharge cell of each of the discharge cells, and the fourth voltage is supplied to the other address electrodes.

13. The plasma display device of claim 12, wherein the each of the discharge cells is divided into a plurality of sub-discharge cells having different phosphors and a reset discharge occurs alternately in the plurality of sub-discharge cells of the each of the discharge cells.

14. The plasma display device of claim 12, wherein a reset discharge occurs alternately in the plurality of sub-discharge cells of the each of the discharge cells on a frame-by-frame basis.

15. The plasma display device of claim 12, wherein, during the setup period, the plurality of sustain electrodes are floated.

16. The plasma display device of claim 12, wherein, during the setup period, a signal whose level gradually increases from a seventh voltage to an eighth voltage is applied to the plurality of sustain electrodes.

17. The plasma display device of claim 12, wherein, during the setup period, a signal whose level gradually increases from a ninth voltage to a tenth voltage is applied to the plurality of sustain electrodes, and during the set-down period, a signal whose level gradually decreases from an eleventh voltage to a twelfth voltage is applied to the plurality of sustain electrodes.

18. A plasma display apparatus, comprising:

a plasma display panel (PDT) including a first and second substrates spaced apart from each other, a plurality of pixels formed between the first and second substrates where a pixel includes a discharge cell of a first color, a discharge cell of a second color, and a discharge cell of a third color, a plurality of scan and sustain electrodes formed on the first substrate and extending in a first direction to cross the discharge cells of first, second and third colors, and a plurality of address electrodes formed on the second substrate and extending in a second direction to cross the discharge cells of the first, second and third colors, the first, second and third colors being different colors; and a driver to provide driving signals to the plurality of scan, sustain and address electrodes based on frames, each frame having a plurality of sub-fields, and each sub-field having at least one of a reset period, an address period, or a sustain period, wherein the discharge cells of the first color are discharged while the discharge cells of the second and third colors are not discharged during the reset period of a first sub-field, the discharge cells of the second color are discharged while the discharge cells of the first and third colors are not discharged during the reset period of a second sub-field, and the discharge cells of the third color are discharged while the discharge cells of the first and second colors are not discharged during the reset period of a third sub-field, the first, second and third sub-fields being different sub-fields.

19. The plasma display apparatus of claim 18, the first sub-field is a sub-field of a first frame, the second sub-field is a sub-field of a second frame, and the third sub-field is a sub-field of a third frame.

20. The plasma display apparatus of claim 19, wherein during the reset period of the first sub-field, a higher constant bias voltage is applied to the address electrodes for the discharge cells of the second and third colors than the address electrodes for the discharge cells of the first color while a gradually increasing voltage is applied to at least one of the scan electrodes or the sustain electrodes.

* * * * *